US011104405B1

(12) United States Patent
Gieseke

(10) Patent No.: US 11,104,405 B1
(45) Date of Patent: Aug. 31, 2021

(54) DEEP WATER BUOYANCY DEVICE

(71) Applicant: The United States of America as represented by the Secretary of the Navy, Newport, RI (US)

(72) Inventor: Thomas J Gieseke, Middletown, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 17/109,177

(22) Filed: Dec. 2, 2020

(51) Int. Cl.

| | |
|---|---|
| ***B63B 22/08*** | (2006.01) |
| ***B63C 7/20*** | (2006.01) |
| ***B63C 7/06*** | (2006.01) |
| ***B63C 11/52*** | (2006.01) |

(52) U.S. Cl.
CPC ..... *B63C 7/20* (2013.01); *B63C 7/06* (2013.01); *B63C 11/52* (2013.01); *B63B 22/08* (2013.01)

(58) Field of Classification Search
CPC ..... B63B 22/08; B63B 22/10; B63B 22/12; B63B 22/14; B63C 7/06; B63C 7/20
See application file for complete search history.

(56) References Cited

U.S. PATENT DOCUMENTS

| | | | | |
|---|---|---|---|---|
| 7,753,754 | B2 * | 7/2010 | Curtis | A63H 23/08 446/153 |
| 8,069,808 | B1 * | 12/2011 | Imlach | B63G 8/22 114/331 |
| 9,321,515 | B2 * | 4/2016 | Edwards | B63C 7/10 |
| 10,308,334 | B2 * | 6/2019 | Kang | B63G 8/24 |
| 10,562,598 | B1 * | 2/2020 | Roger | B63B 22/12 |
| 10,569,839 | B1 * | 2/2020 | Thomson | B63B 22/12 |

* cited by examiner

*Primary Examiner* — Andrew Polay
(74) *Attorney, Agent, or Firm* — James M. Kasischke; Michael P. Stanley

(57) ABSTRACT

An apparatus for creating on-command buoyancy is provided with an elastically deformable and axially elongated watertight hollow shell having a plurality of leaf springs and enveloped by a flexible skin. When flattened, the shell has a small internal volume and is negatively buoyant. The hollow shell is held in this position by a latch mechanism. When the mechanism is released, the leaf springs expand to increase the internal volume of the shell. In this state, the system is buoyant. A release mechanism for the latch bar is provided in a forward closure to permit transition from negatively buoyant to a buoyant configuration when an external signal is received.

7 Claims, 10 Drawing Sheets

DEEP WATER BUOYANCY DEVICE

STATEMENT OF GOVERNMENT INTEREST

The invention described herein was made in the performance of official duties by employees of the United States Department of the Navy and may be manufactured, used, or licensed by or for the Government of the United States of America for any governmental purpose without payment of any royalties thereon.

BACKGROUND OF THE INVENTION

(1) Field of the Invention

The present invention relates to a buoyancy device for recovery of objects in a deep water environment.

(2) Description of the Prior Art

In the marine industry, a need exists for the recovery of deeply submerged objects. At shallow depths, permanent tethers can be employed in which the tethers are similar to tethers used in the lobster industry. In a shallow water recovery, the tethers can be attached by divers or can be attached by remotely operated vehicles. Deployable buoyancy devices can be attached in which the devices are inflated to create lifting forces. Such deployable buoyancy lifting devices are common in vessel recovery operations.

Operations exists where the recovery of undersea objects must be accomplished at deep depths. At these depths, divers cannot reach the objects; remotely-operated vehicle recovery is very expensive; permanent tether recovery is cumbersome and risky; and inflatable buoyancy devices are not practical due to high pressure in deep water.

As such, a buoyancy device is needed that can be activated at high pressures to create flotation for a submerged object.

SUMMARY OF THE INVENTION

It is therefore a primary object and general purpose of the present invention to provide a buoyancy device that can be deployed under high depth pressure to provide floatation recovery for objects attached to the buoyancy device.

It is a further purpose of the present invention to provide a buoyancy device having a structure that can change between a buoyancy state and a negative buoyancy state.

To attain the objects of the present invention; a buoyancy device is provided. The device can change volume between two structural states in which the structural state affects the buoyancy of the device. The buoyancy device has a net density less than water when in a buoyant state and has a net density greater than water when in a negatively buoyant state.

The device for creating an on-command buoyancy includes an elastically deformable and axially elongated watertight hollow shell having an upper surface, a lower surface, an open forward end and an open rear end. A closer is affixed to the open rear end to create a watertight boundary at the end. Another closer is affixed to the open front end to create a watertight boundary at the open front end.

A controllable latch mechanism attaches to the interior surface of the hollow shell. The latch mechanism is centrally positioned in an interior of the hollow shell to hold the hollow shell in a compressed configuration when the upper surface and the lower surface of the shell are pressed together. The shell is held in a compressed configuration until a control signal commands a release. An attaching means can be affixed to the exterior of the buoyancy device for connecting the device to an external structure.

The change in structural state between a high volume state and a low volume state of the hollow shell occurs by the compression of the shell through the application of external pressure. When in a buoyant state, the shell has a cross section with a maximum area and when in a negatively buoyant state, the shell has a cross section with a minimum area.

The lower surface and the upper surface of the elastically deformable and watertight hollow shell includes an elastic frame structure and a flexible watertight skin. The frame structure includes leaf springs with each leaf spring having a curved shape in which the shape is similar to a bow or a sinusoid. Each leaf spring has a rigid mid-section with extending flexible arms and free ends.

The leaf springs are arranged in opposing pairs on a plane perpendicular to the central axis of the buoyancy device. The pairs are positioned side-by-side to form the upper and lower surfaces of the hollow shell. The upper and lower surfaces have a concave surface facing inward to the center of the hollow shell and a convex surface facing outward.

The hollow shell resists compression thru the elasticity of the flexible arms of the leaf springs. When a force is applied to the upper and lower surfaces; the rigid surfaces of the mid-section move inward toward the center of the hollow shell. The free ends of the springs extend outward. A force compression flattens the hollow shell. In the flattened and low volume state; the shell has a smaller cross-sectional area than in a pre-compressed state or a high volume state.

The leaf springs closest to the forward end and the leaf springs closest to the rear end of the shell compress less than the springs near the middle of the shell while under a compression force in order to allow a smooth geometric transition from the middle portion of the hollow shell to the closures at the ends.

Non-linear spring behavior is realized when the applied force is a uniform pressure. In the buoyant state, the uniform pressure acts to press the rigid mid-sections of the springs inward toward the central axis of the hollow shell. An opposing force acts to press the free ends of the leaf springs inward toward the central axis of the hollow shell.

The forces on the free ends of the springs are orthogonal to the forces acting on the rigid mid-sections of the springs and thereby resist compression. As a result, the rate of the volume of the hollow shell changes to applied pressure is less while in the buoyant state than the volume in the negatively buoyant state.

A latch mechanism secures the shell in the negatively buoyant state until a transition to a buoyant state. The latch mechanism is contained in and extends from the forward closure of the hollow shell. The latch mechanism includes protrusions attachable to the mid-sections of the leaf springs extending inward toward the central axis of the shell, a segmented latch bar, and a latch bar extension and retraction mechanism.

The protrusions of the segmented latch bar have tapered apertures with a central axis perpendicular to the plane of the leaf springs. When the springs are in a compressed state; the apertures on the protrusions on the springs align. When in an aligned state, the segmented latch bar passes thru the apertures to secure the springs from opposite sides of the hollow shell and to prevent the springs from expanding.

The extension and retraction mechanism for the segmented latch bar further includes a spool to hold the latch bar and a common axle rotationally connecting the spool with a coil spring. The latch bar mechanism includes a rotational means for the common axle exterior to the forward closure in order to extend the segmented latch bar while simultaneously torsioning the coil spring.

A stopper pin prevents rotation of the spool and holds the segmented latch bar in an extended configuration. When needed, a servo-mechanism retracts the stopper pin. Alternatively, a manually activated knob can retract the stopper pin. The segmented latch bar is retracted and wrapped onto the spool by the coil spring when the spool and the coil are released by retracting the stopper pin. In a buoyant state, the hollow shell expands. The latch bar is coiled onto the spool; the coil spring is not torsioned and the servo is in a retracted state.

To place and hold the buoyancy device in a negatively buoyant state; an external force is applied to compress the shell and to align the apertures in the protrusions of the springs. An external rotation is applied to the common axis of the spool and the coil spring where the axle protrudes through an aperture in the surface of the forward closure. The segmented latch bar is inserted through the apertures of the protrusions which are affixed to the springs.

As the latch bar is inserted, the coil spring is torsioned. When the latch bar reaches the apertures in the springs closest to the rear closure; the servo is actuated. A notch in the spool is provided to receive the stopper pin. When the stopper pin is inserted into the notch, the rotation of the spool is prevented. The buoyancy device is then in a flattened and negatively buoyant state.

When at an operating depth and when attached to a structure that requires buoyancy; the buoyancy device is actuated by either manually pulling the stopper pin or by sending an acoustic signal to a receiver. The control system which is responsive to external acoustic signals sends a retraction command to the servo-mechanism. Once released, the coil spring draws the segmented latch bar out of the apertures in the protrusions of the springs; thereby, allowing the spool to rotate under the rotational force of the coil spring.

Once released, the coil spring draws the segmented latch bar out of the apertures of the springs with the result of allowing the springs to expand to open the hollow shell. When the segmented latch bar is fully retracted and the springs have expanded; the device becomes fully buoyant.

Because the elastic frame structure with leaf springs is not watertight; a waterproof skin is wrapped around the hollow shell of the buoyancy device and is sealed at the edges. A longitudinal structural member is incorporated between the forward and aft closures of the hollow shell to resist compressive forces acting on the hollow shell.

BRIEF DESCRIPTION OF THE DRAWINGS

Features of illustrative embodiments may be understood from the accompanying drawings in conjunction with the detailed description. The elements in the drawings may not be drawn to scale. Some elements and/or dimensions are enlarged or minimized for the purpose of illustration and the understanding of the disclosed embodiments.

DETAILED DESCRIPTION OF THE INVENTION

Systems and methods exist for creating buoyancy in an underwater system. The present invention is in this general category but employs a novel arrangement of components. These components comprise a device that can transform from a negatively buoyant state to a buoyant state through the relaxation of an elastically deformable structure affixed to a plurality of leaf springs.

Figure 1:
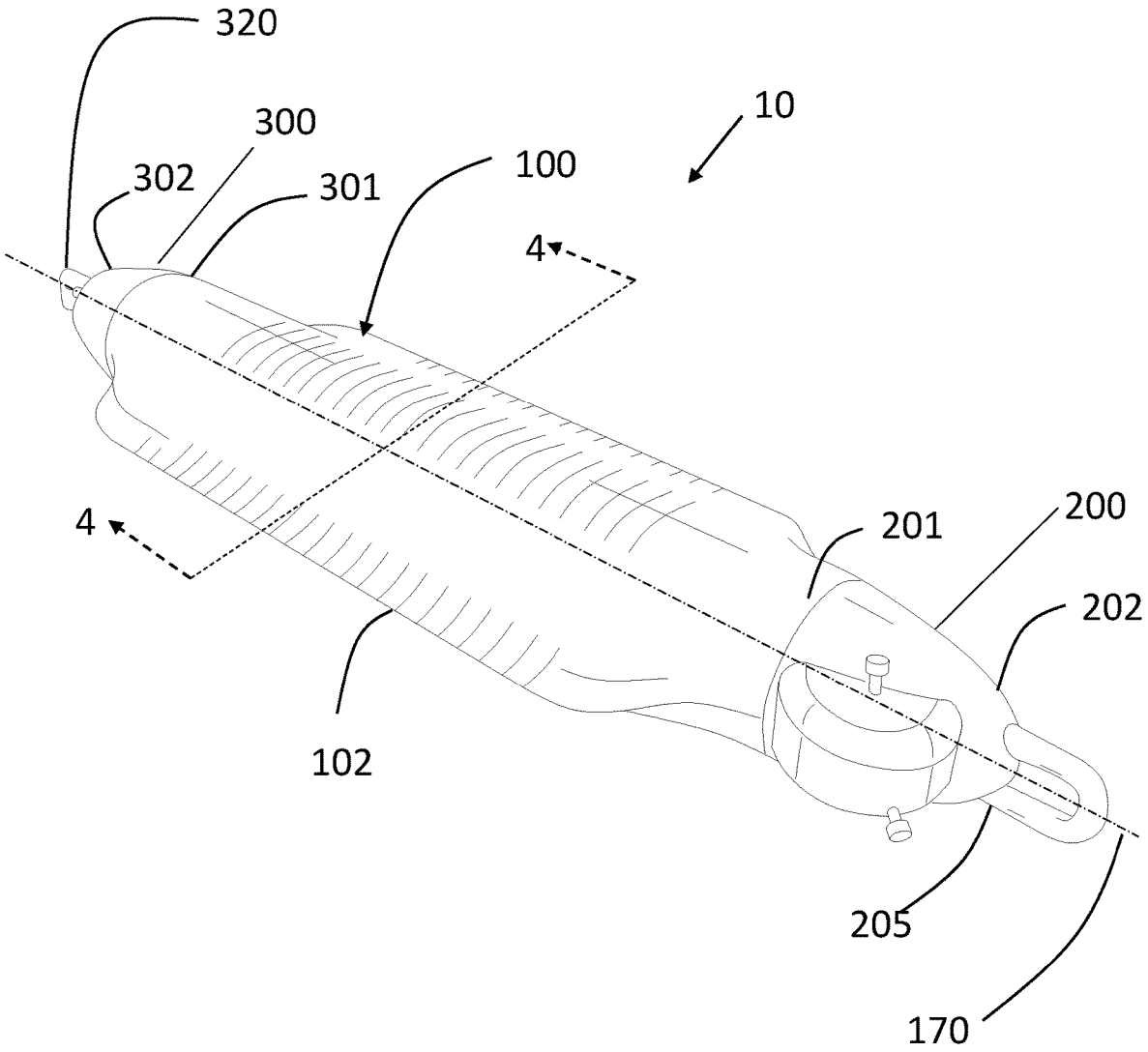
FIG. 1 depicts a perspective view of the buoyancy device in a buoyant state.

FIG. 1 depicts a perspective view of a buoyancy device 10 of the present invention. A hollow shell 100 is positioned between a forward closure 200 and a rear closure 300. A forward direction is defined along a longitudinal axis in the direction of the forward closure 200 away from the rear closure 300. In the figure, the hollow shell 100 is in the buoyant state.

The rear closure 300 has a first surface defining an outer profile 301 and a second surface forming a rigid shell structure 302. The forward closure 200 comprises a first surface defining an outer profile 201 and a second surface forming a rigid shell structure 202. The forward closure 200 is a bulbous three-dimensional shape to encompass and protect internal components of the buoyancy device 10 and to prevent water intrusion into the device.

A first pad-eye 205 is attached to the forward end of the forward closure 200. A second pad-eye 320 is attached to the rear closure 300.

A waterproof flexible material forming a skin 102 is stretched over the hollow shell 100 and sealed to the back edge of the forward closure 200 along an outer profile 201 and the forward end of the rear closure 300 along a rear closure outer profile 301. The buoyancy device 10 has a central longitudinal axis 170.

Figure 2:
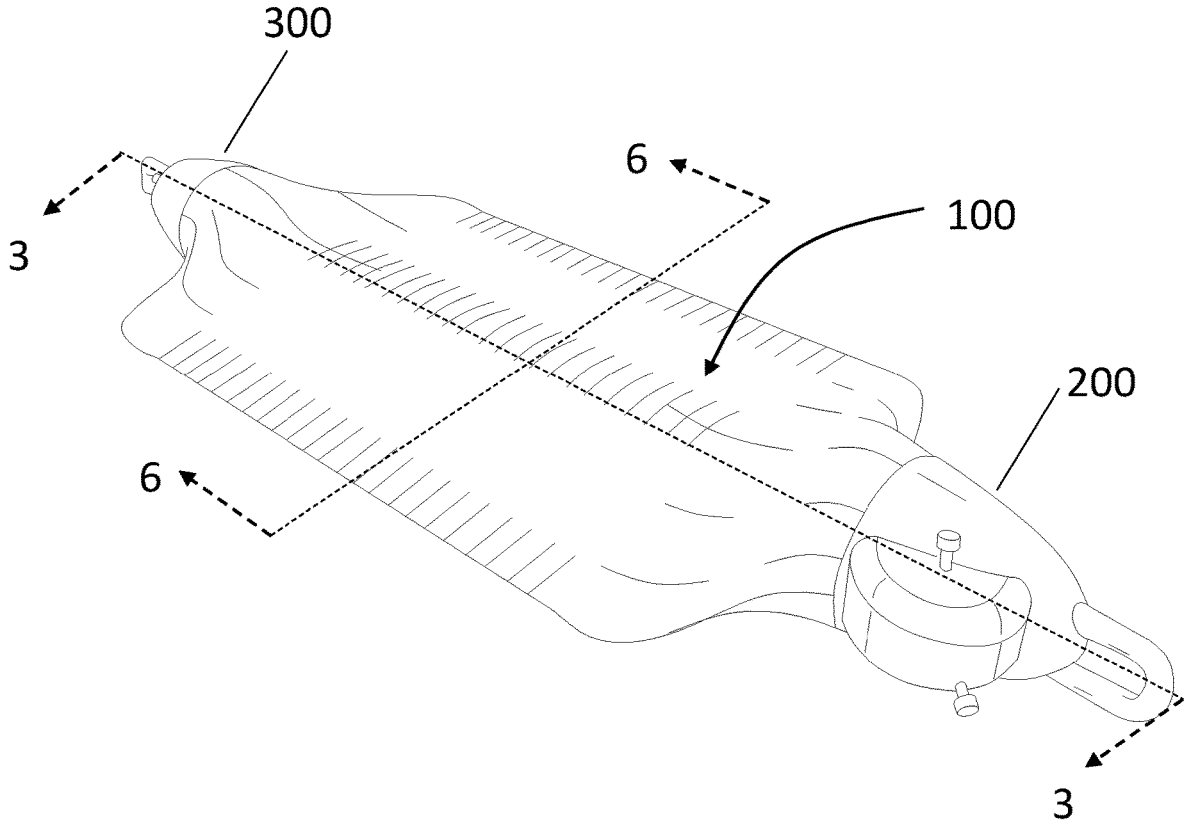
FIG. 2 depicts a perspective view of the buoyancy device in a negatively buoyant state.

FIG. 2 depicts the buoyancy device 10 in which the hollow shell 100 is in a flattened shape with the shell having a reduced internal volume. The configuration change from the buoyant state depicted in FIG. 1 to the negatively buoyant state in FIG. 2 is achieved by geometric changes in the structure of the hollow shell 100.

Figure 3:
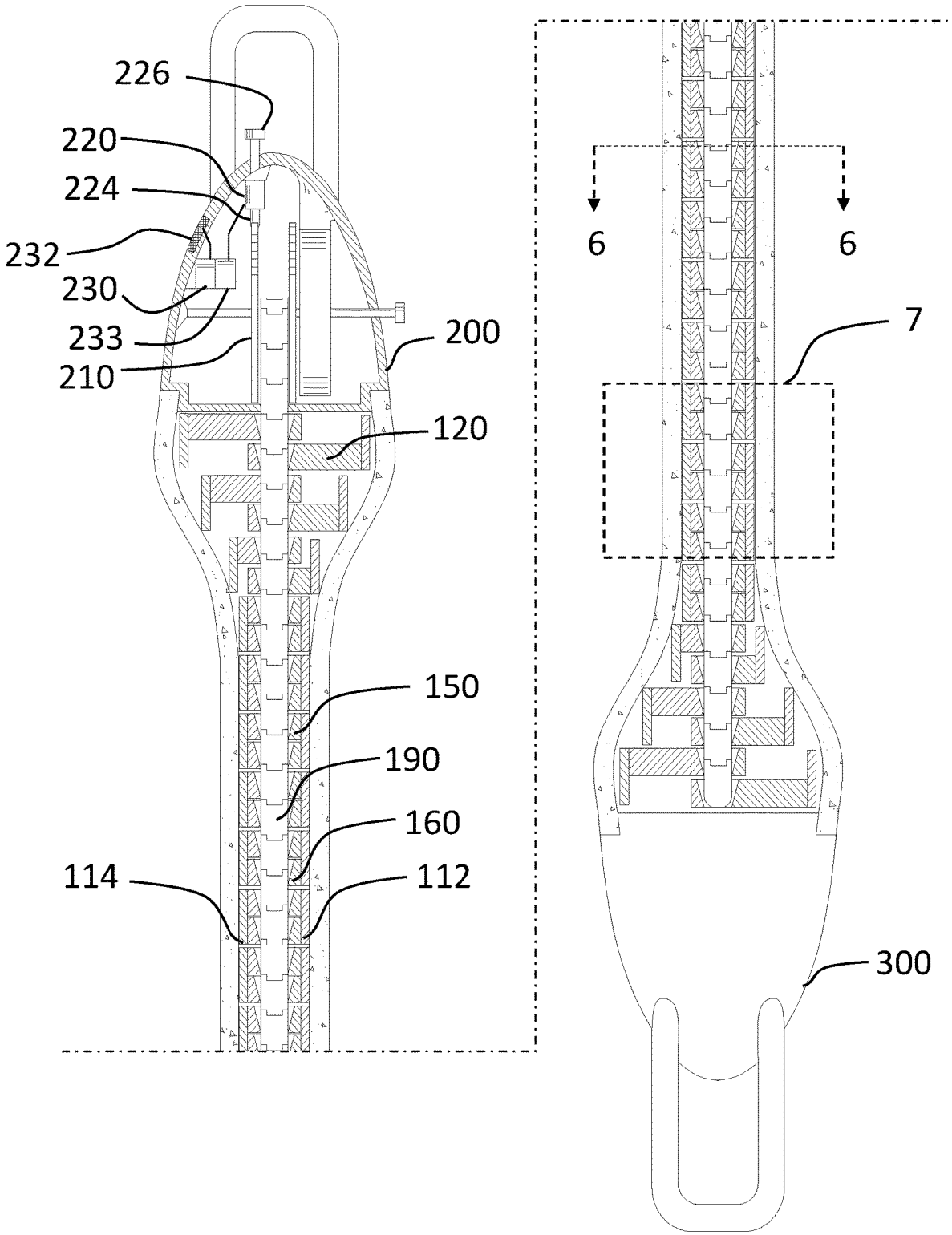
FIG. 3 depicts a longitudinal cross-section of the buoyancy device in a negatively buoyant state with the cross-section taken along the reference lines 3-3 of FIG. 2.
Figure 4:
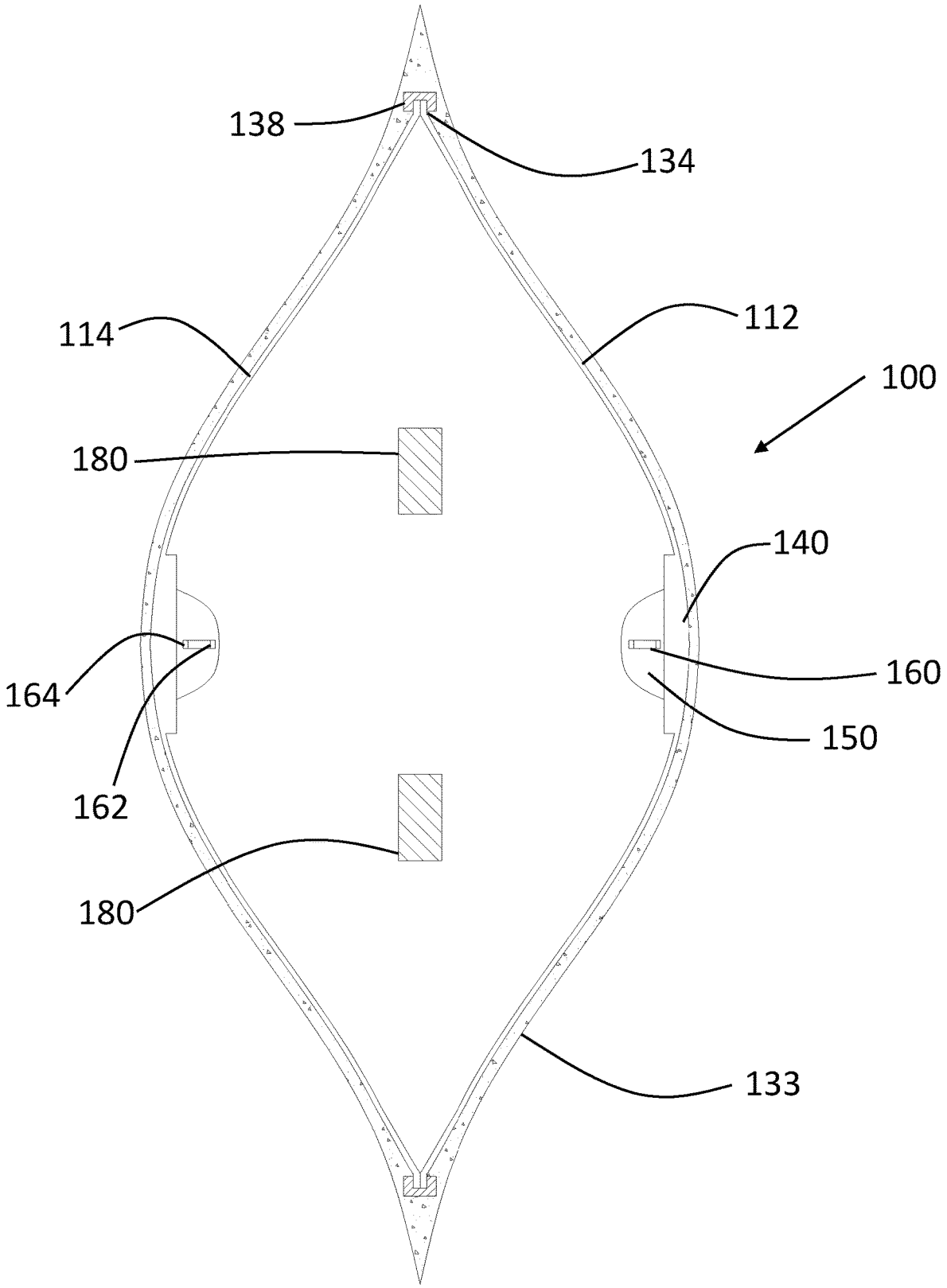
FIG. 4 depicts a lateral cross-section of the buoyancy device in a buoyant state with the cross-section taken along the reference lines 4-4 of FIG. 1.

FIG. 3 is a longitudinal cross-section of the buoyancy device 10 with an illustration of the major components of the device. FIG. 4 depicts a lateral cross-section of the shell 100 at a mid-point corresponding to the buoyancy state of FIG. 1. The hollow shell 100 has a plurality of leaf springs with each leaf spring having a bowed shape. Opposing pairs of springs include an upper spring 112 and a lower spring 114.

The upper spring 112 and the lower spring 114 have flexible arms 133, free ends 134, and a stiffened mid-section 140.

Clamp bars 138 connect the free ends 134 and fasten the upper springs 112 and the lower springs 114 together. The clamp bars 138 are nominally aligned with the central axis 170 of the buoyancy device 10. The clamp bars 138 are flexible along their primary axis to allow longitudinal elongation and stiffened in a cross-sectional plane to maintain a cross-sectional shape while clamping the free ends 134. The clamp bars 138 preferably have a "C" cross-sectional shape.

A protrusion 150 is affixed to each mid-section 140 of the upper spring 112 and the lower spring 114. The protrusions 150 extends inward to the central axis 170. The protrusions 150 have flat forward and rear surfaces in a plane perpendicular to the central axis 170. The protrusions 150 have tapered rectangular apertures 160.

The axis of the apertures 160 is parallel to the central axis 170 of the buoyancy device 10. Each of the apertures 160 has a small cross-sectional area 162 at a rear end and a large cross-sectional area 164 at a forward end. The apertures 160 are longer along a vertical axis than along a horizontal axis.

Figure 5:
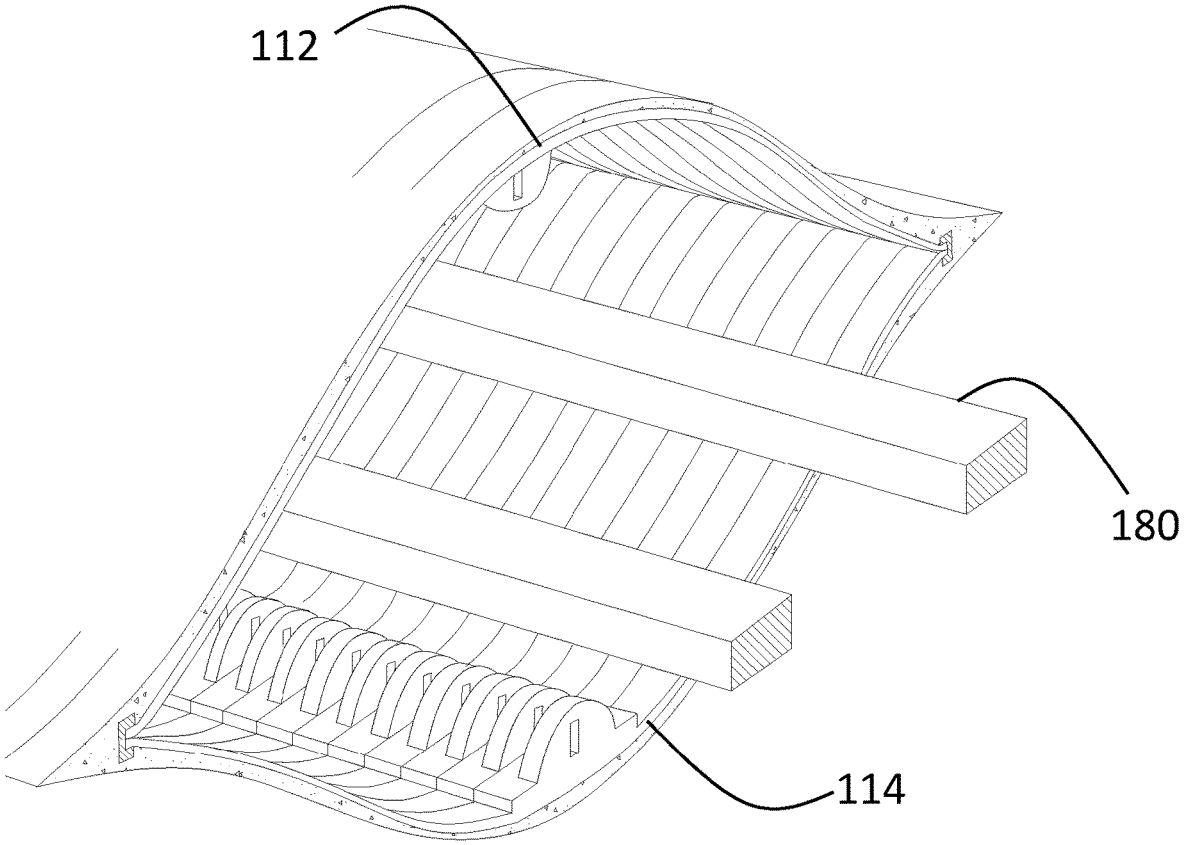
FIG. 5 depicts a lateral cross-section of the buoyancy device in a perspective view.

FIG. 5 depicts a cross-section of the hollow shell 100 in a buoyant state. In the figure, structural members 180 are positioned parallel to the central axis 170 and extend from the rear closure 300 to the forward closure 200 to provide longitudinal strength for the buoyancy device 10. The longitudinal arrangements of the upper spring 112 and lower spring 114 are also shown in the figure.

Figure 6:
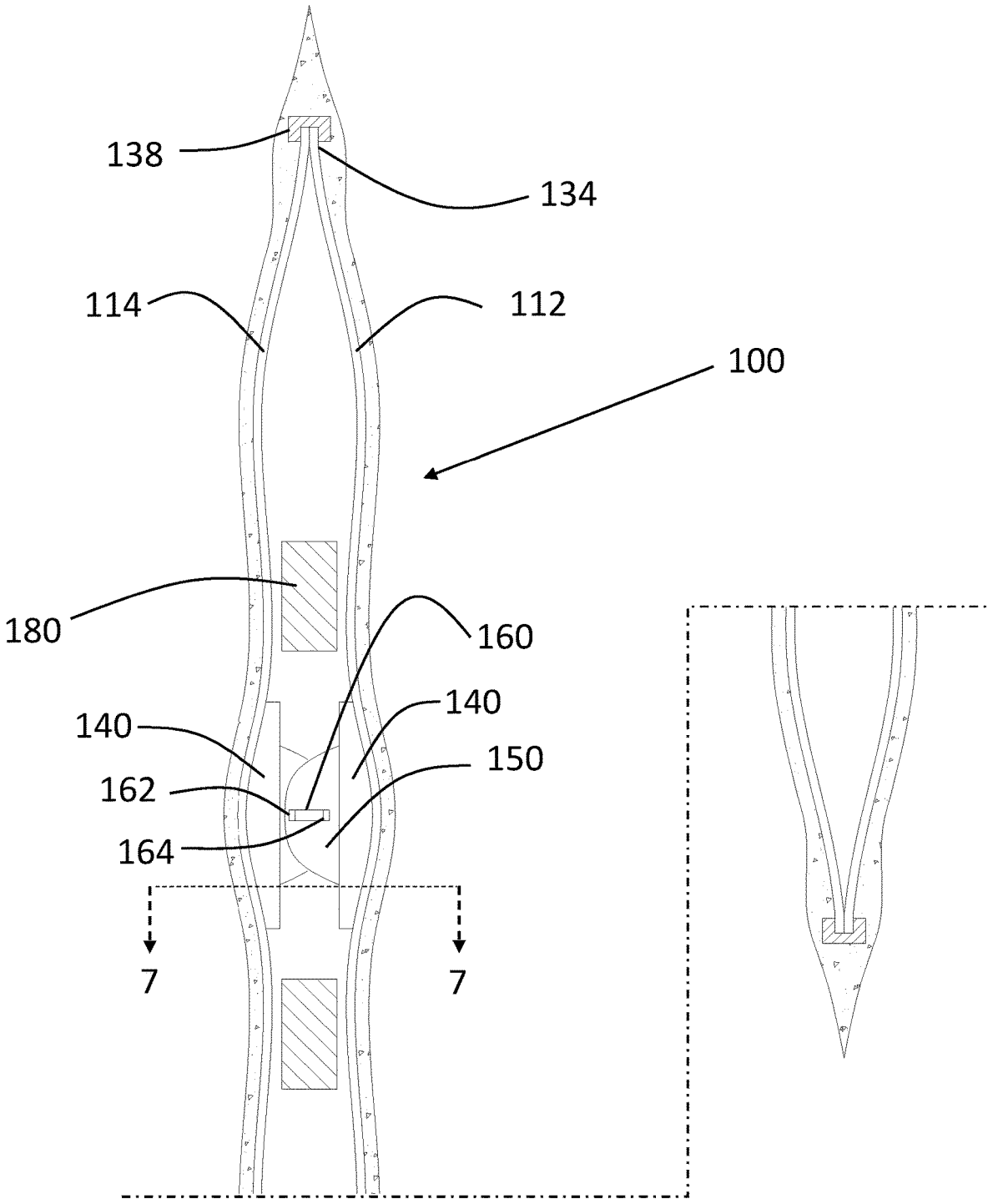
FIG. 6 depicts a lateral cross-section of the buoyancy device in a negatively buoyancy state with the cross-section taken along the reference lines 6-6 of FIG. 2 and FIG. 3.

FIG. 6 depicts a cross-section of the hollow shell 100 at a mid-point corresponding to a negatively buoyant state. In the negatively buoyant state, the opposing pairs of the upper springs 112 and the lower springs 114 are pressed toward the central axis 170 such that the stiffened mid-sections 140 are in close proximity and the axes of the apertures 160 in the protrusions 150 are aligned.

Returning to FIG. 3, a segmented latch bar 190 passes thru the apertures 160. The presence of the segmented latch bar 190 prevents expansion of the upper springs 112 and the lower springs 114 until the segmented latch bar is removed. The latch bar 190 has rectangular segments connected to form a chain-like structure. The chain-like structure resists bending in the plane containing the pivotal linkages but allows the structure to bend the plane allowing the structure to be wrapped around circular hubs. The cross-sectional dimensions of the segments of the latch bar 190 allow insertion into the apertures 160.

Figure 7:
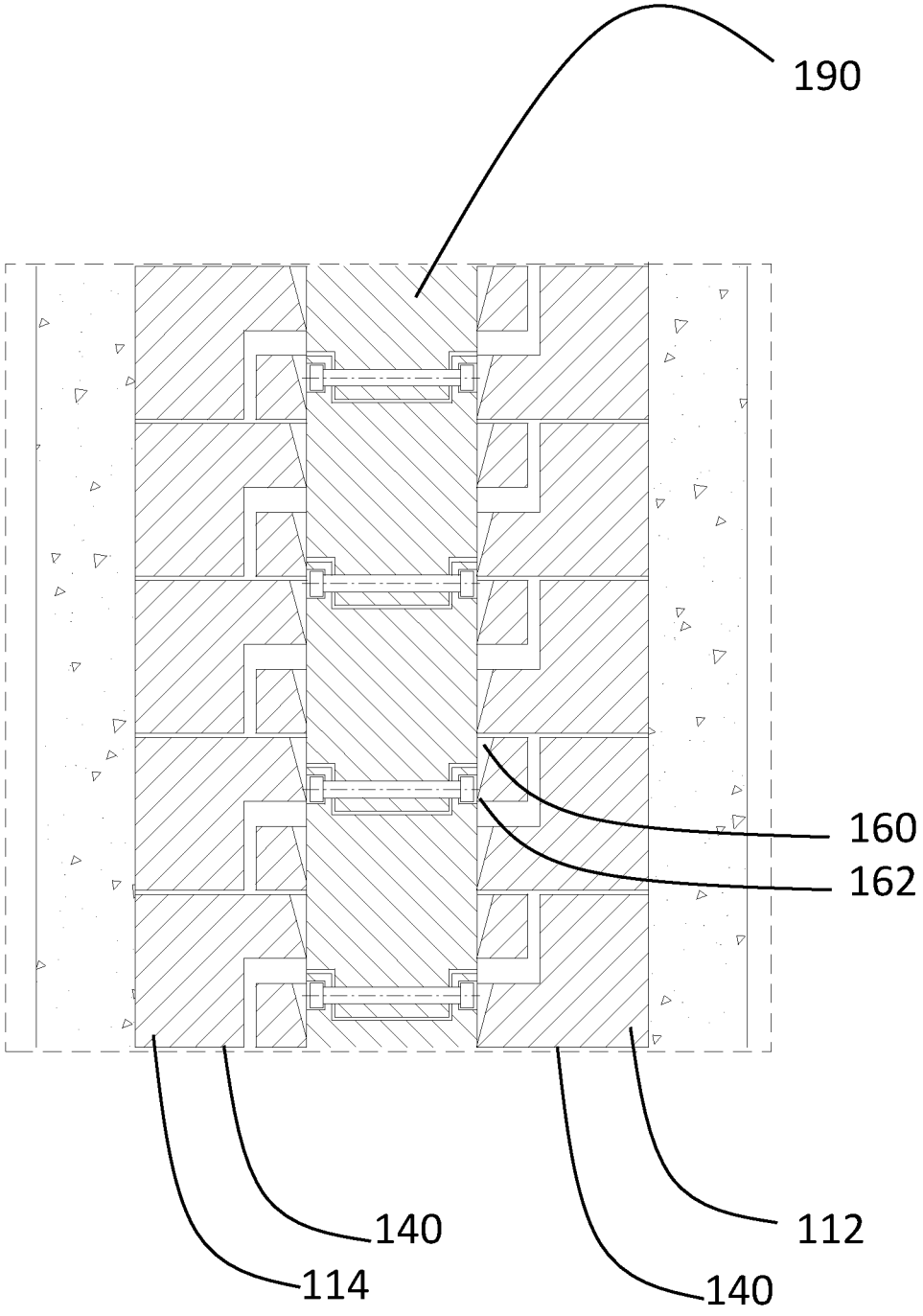
FIG. 7 depicts a longitudinal cross-section of a portion of the hollow shell with the latch bar partially retracted with the cross-section taken within reference lines 7-7 of FIG. 3 and of FIG. 6.

In FIG. 7, the positioning of the segmented latch bar 190 resists expansion of opposing pairs of the upper springs 112 and the lower springs 114 as depicted in a longitudinal cross-section of a portion of the hollow shell 100. The stiffened mid-sections 140 of the opposing upper springs 112 and the lower springs 114 are pressed together; thereby, flattening the bow of the springs.

In this state, elastic forces in flexible arms 135 act to force the mid-sections 140 apart. The perimeter of the small cross-section 162 of the apertures 160 contacts the segmented latch bar 190. Each upper spring 112 and each lower spring 114 applies an opposing force on the latch bar 190. The segmented latch bar 190 prevents expansion of the pairs of the upper springs 112 and the lower springs 114. In the negatively buoyant state depicted in FIG. 3, FIG. 6 and FIG. 7, the buoyancy state is in equilibrium and will not change configuration unless the segmented latch bar 190 is removed.

Figure 8:
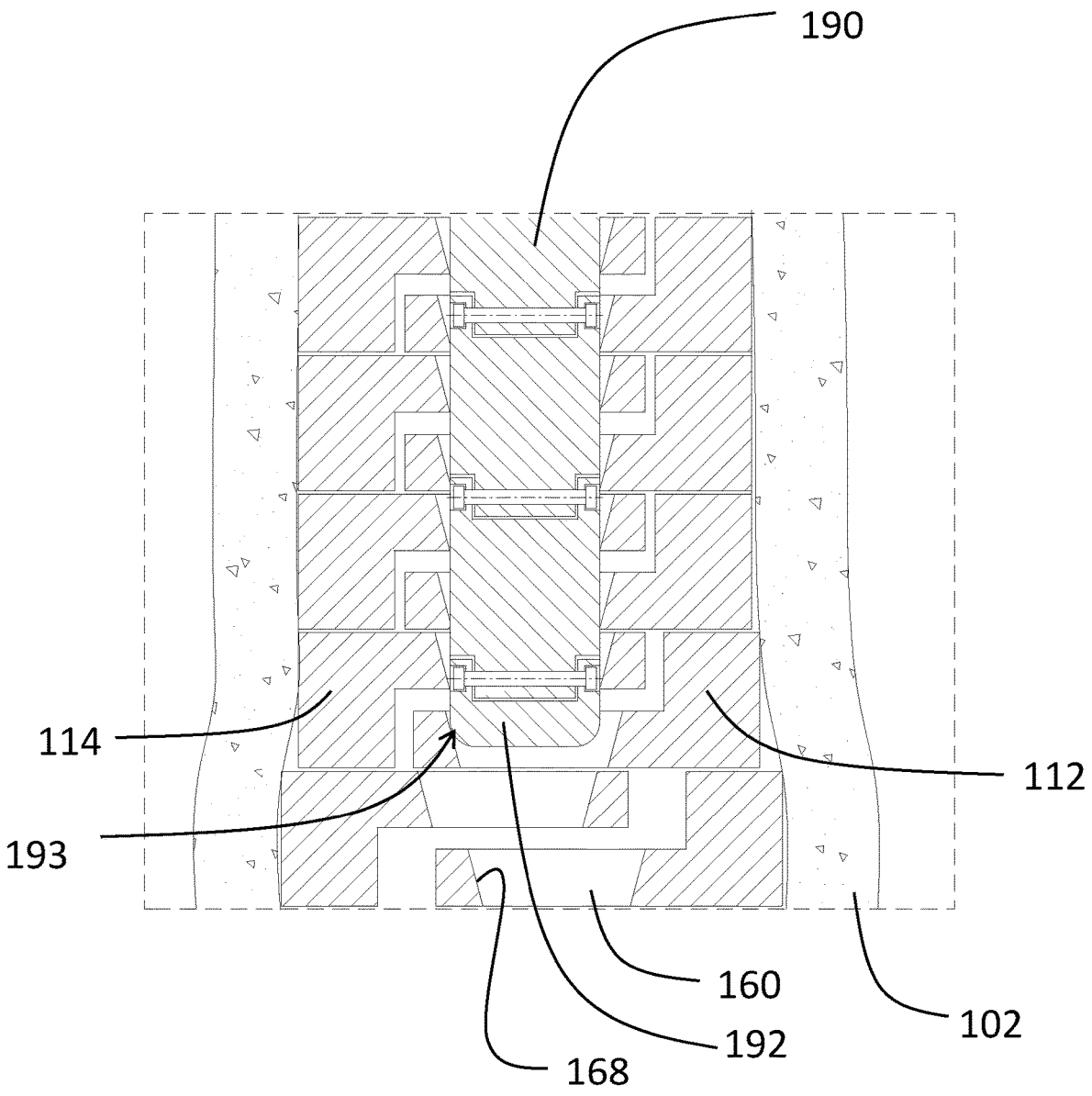
FIG. 8 depicts a longitudinal cross-section of a portion of the hollow shell with the latch bar engaged.

FIG. 8 depicts the positioning of the segmented latch bar 190 and a portion of the hollow shell 100 in a longitudinal cross section view when the latch bar has been partially extracted from the apertures in the mid-sections 140. The latch bar 190 is completely retracted from a rear-most set of opposing springs 116. The rear-most set of opposing springs 116 are able to expand against the resistance of the skin 102.

The segmented latch bar 190 remains in place in a forward-most set of opposing springs 118. The forward-most set of opposing springs 118 are prevented from expanding. A free end 192 of the latch bar 190 is retracted to a position where the latch bar is partially engaged with the lower spring 114 and the upper spring 112.

In this position, the center upper spring 112 is prevented from expanding and the center lower spring 114 moves downward slightly. At a point of contact 193 between the free end of the segmented latch bar 192 and the aperture 160 in the center lower spring 114; contact forces act to drive the latch bar out of the apertures sequentially disengaging from the pairs of the upper springs 112 and the lower springs 114.

A low friction surface coating 168 is added to the internal surfaces of the apertures 160 to facilitate longitudinal movement of the latch bar 190 within the apertures.

Returning to FIG. 3, the interior of the forward closure 200 is partially shown. In the depicted configuration, the buoyancy device 10 is in a negatively buoyancy state with the latch bar 190 passing thru the apertures 160 in the protrusions 150 in the pairs of the upper springs 112 and the lower springs 114. Traditional springs 120 have changes in protrusion length close to the rear closure 300 and the forward closure 200.

A spool 210 receives one end of the segmented latch bar 190. The diameter of the spool 210 is such that the segmented latch bar 190 can be fully wrapped around the spool when the latch bar is retracted into the forward closure 200. A servo 200 with a stopper pin 224 is deployed to prevent the spool 210 from rotating.

Figure 9:
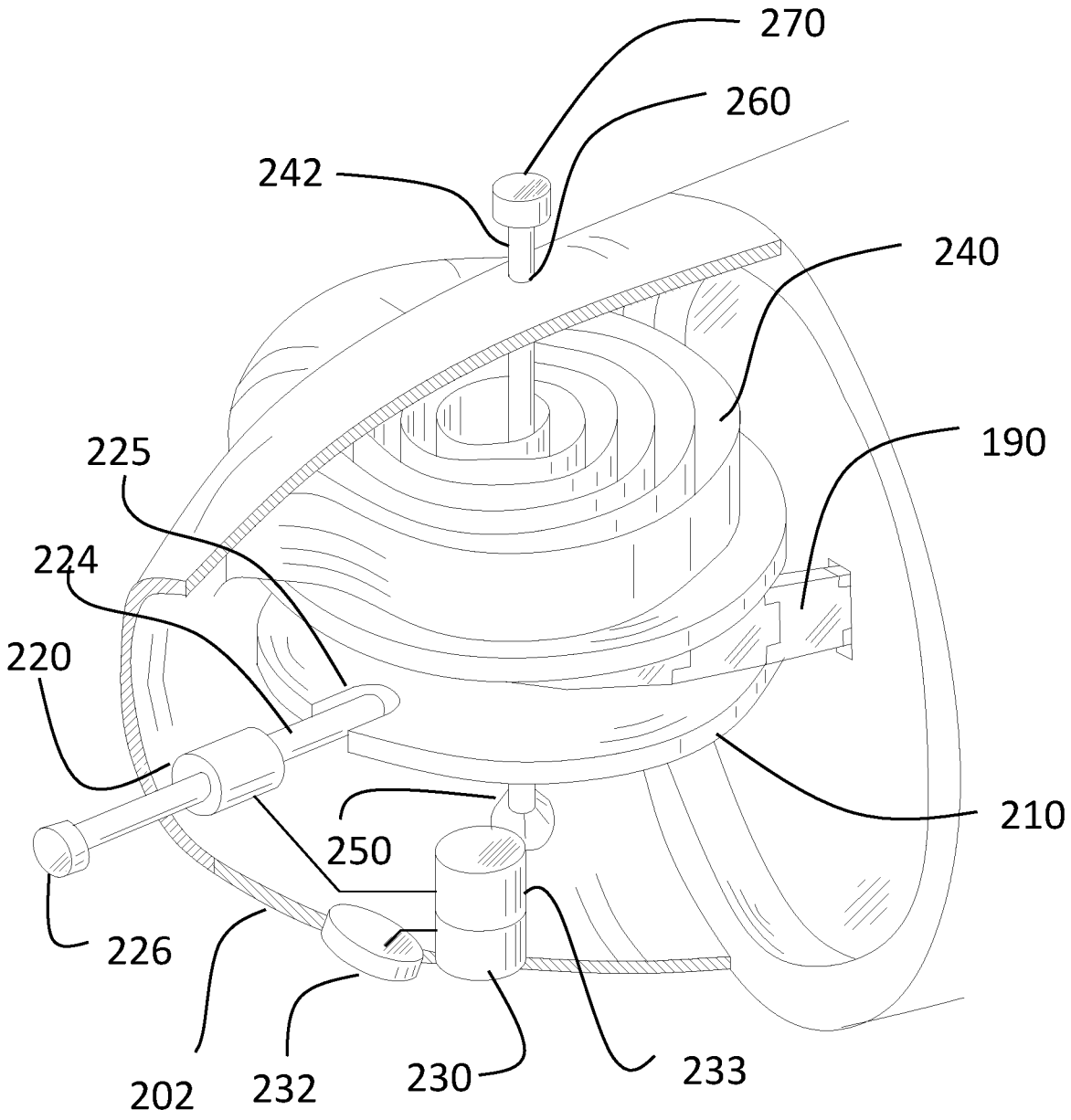
FIG. 9 depicts an isometric view of the internal elements of the latch bar retraction and extension mechanism.

In FIG. 9, a receiver location 225 along the periphery of the spool 210 is provided to receive the stopper pin 224 when actuated. A controller 230 is employed to actuate a servo-mechanism 220 to retract the stopper pin 224. Alternatively, a manual pull pin 226 can retract the stopper pin 224.

An acoustic transducer 232 and receive electronics 233 are employed to receive and interpret acoustic signals from a remote transmitter (not shown) to produce an electronic actuation command signal, which is electronically transmitted to the servo controller 230 to retract the stopper pin 224.

The figure shows the internal elements of the forward closure 200. A torsional spring 240 is positioned co-axially with the spool 210. A housing 250 with a tapered roller bearing is positioned on the interior surface of the forward closure shell 202 to receive a first end of a common axle 242.

A watertight bearing 260 is positioned in an aperture in the exterior shell of the forward closure 200 to allow passage of a second end of a common axle 242 through the exterior shell of the forward closure 200. A fitting to receive a crank 270 is affixed to the end of the common axle 242.

Figure 10:
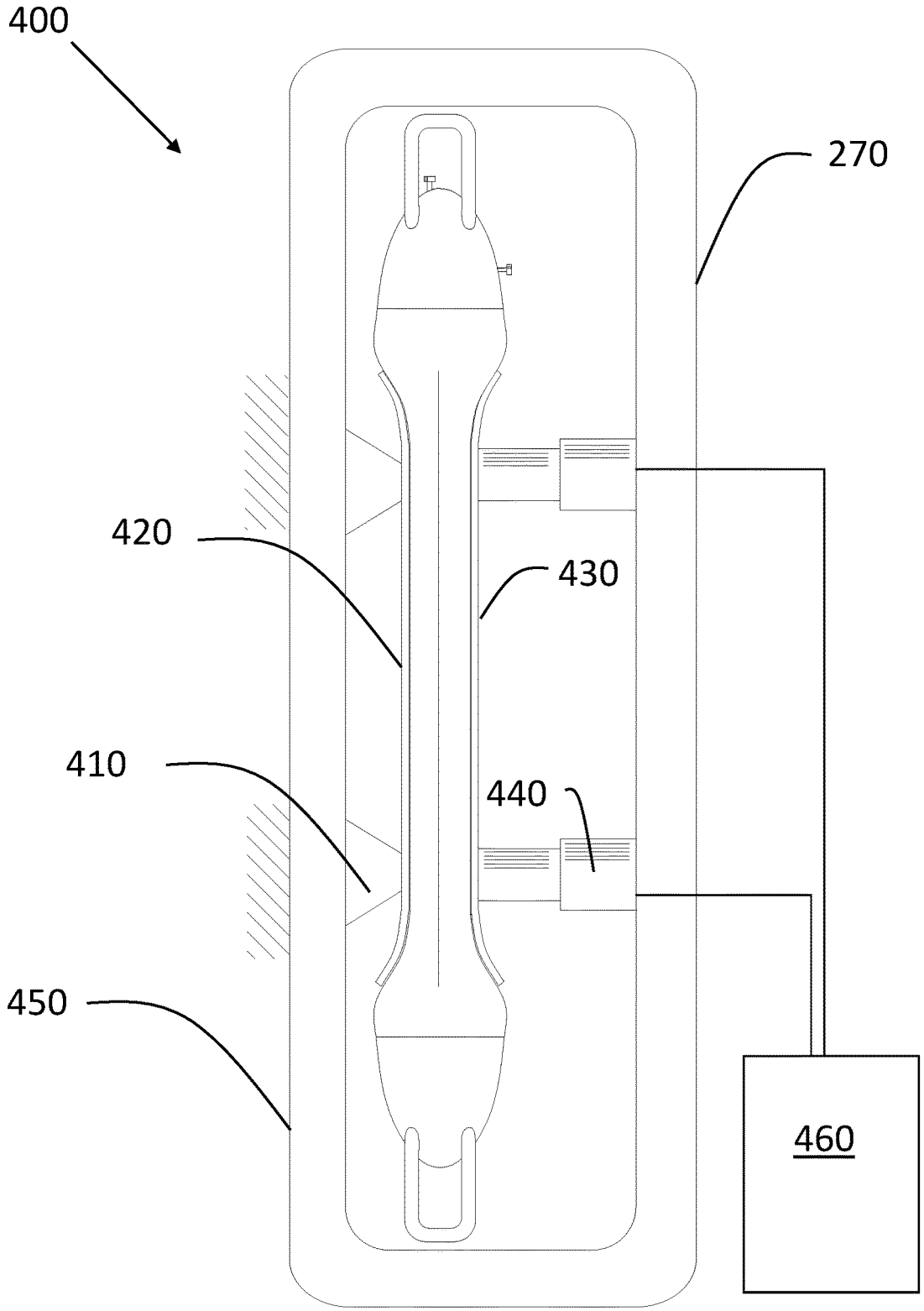
FIG. 10 depicts a side view of the buoyancy device while the device is in a press.

To convert the buoyancy device 10 from a buoyant state to a negatively buoyant state, a means to compress the structure is required. FIG. 10 illustrates a press system 400 suitable for the purpose of compressing the buoyancy device 10. The press system 400 includes a base 410, a shaped lower surface 420, a shaped upper surface 430, hydraulic rams 440 and a frame 450 structurally connecting the hydraulic rams to the base and a control system 460.

The press system 400 is used during the conversion of the buoyancy device 10 from a buoyant state to a negatively buoyant state. The conversion is accomplished by placing the buoyancy device 10 into the press system 400. Prior to compressing the buoyancy device 10; the latch bar 190 is wrapped on the spool 210 and the stopper pin 224 is retracted. The press system 400 is subsequently employed using the control system 460 to compress the hollow shell 100 to align the apertures 160 in the upper springs 112 and the lower springs 114.

Returning to FIG. 9, the crank 270 is attached to the common axle 242. Through rotation of the common axle 242; the latch bar 190 is unwrapped from the spool 210 and driven through the apertures 160 in the upper springs 112 and the lower springs 114. The rotation of the common axle 242 rotationally tightens the torsional spring 240 such that the torsional spring applies a torque to the common axle 242 thus imparting a retraction force (increasing as the rotation increases) to the segmented latch bar 190 while wrapping the latch bar onto the spool 210.

It should be recognized that, in the light of the above teachings, those skilled in the art could modify those specifics without departing from the invention taught herein. Having now fully set forth certain embodiments and modifications of the concept underlying the present disclosure, various other embodiments as well as potential variations and modifications of the embodiments shown and described herein will obviously occur to those skilled in the art upon becoming familiar with such underlying concept. It is intended to include all such modifications, alternatives, and other embodiments insofar as they come within the scope of the appended claims or equivalents thereof. It should be understood, therefore, that the invention might be practiced otherwise than as specifically set forth herein. Consequently, the present embodiments are to be considered in all respects as illustrative and not restrictive.

What is claimed is:

1. A buoyancy device comprising:

an elastically deformable and axially elongated hollow shell having an upper surface, a lower surface, an open forward end and an open rear end;

a closure affixed to the open rear end of said hollow shell to create a watertight boundary;

a closure affixed to the open front end of said hollow shell to create a watertight boundary;

a segmented latch bar accessible to an interior of said hollow shell and centrally positioned to be capable of holding said hollow shell in a compressed configuration until a control signal commands release with a result of increasing volume and buoyancy of said hollow shell; and an attachment means affixed to an exterior of said buoyancy device for connecting to an external structure.

2. The buoyancy device in accordance with claim 1, wherein said hollow shell further comprises:

a plurality of leaf springs positioned on an interior of said elastically deformable hollow shell with each of said leaf springs having a curved bow profile defining concave sides and convex sides of said springs and with said springs having a rigid mid-section, a right free end and a left free end wherein said springs are grouped as an upper spring and a lower spring;

wherein said concave side of said upper spring is positioned to mirror said concave side of said lower spring across a horizontal line of vertical symmetry of said hollow shell;

wherein said leaf springs are further arranged such that the right free end of said upper spring contacts the right free end of said lower spring and such that the left free end of said upper spring contacts the left free end of said lower spring; and wherein said leaf springs are placed to span the distance between said closure affixed to the open rear end of said hollow shell and to said closure affixed to the open forward end of said hollow shell.

3. The buoyancy device in accordance with claim 2, wherein said closures are clamping bars having a c-shaped cross section with an open channel on a first edge and a closed face on a second edge with each open channel receiving the free end of one of said leaf springs;

at least one structural member parallel to a central and longitudinal axis of said hollow shell laterally offset therefrom to provide longitudinal strength to said hollow shell; and a flexible and watertight skin boundary enveloping an outside periphery of said hollow shell from said closure affixed to the open rear end of said hollow shell to said closure affixed to the open forward end of said hollow shell.

4. The buoyancy device in accordance with claim 3, wherein said closure affixed to the open rear end of said hollow shell has a bulbous three dimensional shape as a housing to encompass said latch bar mechanism.

5. The buoyancy device in accordance with claim 4, further comprising a plurality of protrusions affixed to the rigid mid-sections of said leaf springs to attach said segmented latch bar to said leaf springs wherein each of said protrusions has a first flat surface facing the forward end of said hollow shell and a second flat surface facing the rear end of said hollow shell;

wherein each of said protrusions is positioned such that the first flat surface and the second flat surfaces are on the concave surface of said springs to extend partially from the concave surface toward the central axis of said hollow shell;

wherein each of said protrusions has a rectangular aperture with said aperture larger along a vertical axis than along a horizontal axis and having a vertical extent smaller on a first surface closer to the rear end of said hollow shell than a vertical extent closer to the rear end with said apertures centered relative to the vertical axis of horizontal symmetry of said hollow shell.

6. The buoyancy device in accordance with claim 5, wherein said segmented latch bar has a cross section dimensioned to be insertable through said apertures in said protrusions for securing said leaf springs in a compressed state;

wherein segments of said segmented latch bar are pivotally linked together to have a length greater than a total length of said hollow shell with said segmented latch bar having a first end positioned in the rectangular aperture in said leaf spring pair to the closure affixed to the open rear end and said segmented latch bar having a second end positioned external to said hollow shell inside said housing.

7. The buoyancy device in accordance with claim 6, said buoyancy device further comprising a segmented latch bar retraction mechanism positioned within said housing with said retraction mechanism capable of withdrawing said segmented latch bar out of said apertures;

a spool having a first side wall and a second side wall with said spool incorporating a notch in an outer periphery of said first side wall and said second side wall with a diameter such that said segmented latching bar is capable of being wrapped around a hub of said spool;

a common axle with a rotational means, said common axle positioned inside of said housing with an axis of rotation parallel to a vertical axis of horizontal symmetry of said hollow shell with said common axle having a first end secured to the inside surface of said housing with means to reduce rotational friction and said common axle having a second end passing through the surface of said housing wherein said spool is positioned on and rotationally affixed to said axle;

a torsional spring having a first end attached to said common axle and said torsional spring having a second end attached to said housing, said torsional spring wrapped to be capable of a maximum torque to said common axle when said segmented latching bar is fully unwrapped from said spool;

a stopper pin passing through housing to prevent rotation of said spool until said stopper pin is retracted; and a retraction mechanism for said stopper pin with said retraction mechanism responsive to control signals.

* * * * *